US005348596A

United States Patent [19]

Goleniewski et al.

[11] Patent Number: 5,348,596

[45] Date of Patent: Sep. 20, 1994

[54] SOLID PROPELLANT WITH NON-CRYSTALLINE POLYETHER/INERT PLASTICIZER BINDER

[75] Inventors: John R. Goleniewski; James A. Roberts, both of Salt Lake County, Utah

[73] Assignee: Hercules Incorporated, Wilmington, Del.

[21] Appl. No.: 398,210

[22] Filed: Aug. 25, 1989

[51] Int. Cl.[5] ..... C06B 45/10

[52] U.S. Cl. ..... 149/19.6; 149/19.4

[58] Field of Search ..... 149/19.4, 19.6

[56] References Cited

U.S. PATENT DOCUMENTS

| | | | |
|---|---|---|---|
| 3,793,099 | 2/1974 | Duerksen | 149/19.4 |
| 3,809,585 | 5/1974 | Greenberg | 149/19.4 |
| 4,234,364 | 11/1980 | Robinson, Jr. | 149/19.4 |
| 4,298,411 | 11/1981 | Godsey | 149/19.4 |
| 4,482,406 | 11/1984 | Stephens et al. | 149/19.4 |
| 4,482,411 | 11/1984 | Stephens et al. | 149/19.4 |
| 4,483,978 | 11/1984 | Manser | 149/19.6 |
| 4,638,735 | 1/1987 | Lelu et al. | 149/19.4 |
| 4,764,586 | 8/1988 | Manser et al. | 149/19.6 |
| 4,799,980 | 1/1989 | Reed | 149/19.4 |
| 4,804,424 | 2/1989 | Hinshaw | 149/19.6 |
| 4,806,613 | 2/1989 | Wardle | 149/19.6 |
| 4,915,755 | 4/1990 | Kim | 149/19.4 |

FOREIGN PATENT DOCUMENTS 1059261 2/1967 United Kingdom .

*Primary Examiner*—Edward A. Miller

*Attorney, Agent, or Firm*—Mark Goldberg; Mark D. Kuller

[57] ABSTRACT

A solid propellant composition comprising an oxidizer, a fuel and a binder, wherein the binder comprises, based on the weight of the total propellant composition:

(a) from about 3 to about 12% of a non-crystalline polyether having a molecular weight of from about 1000 to about 9,000, and (b) from about 1 to about 12% of an inert plasticizer. Propellants of this invention can be used, for example, in ground-launched interceptors, air launched tactical motors, and space boosters.

18 Claims, No Drawings

SOLID PROPELLANT WITH NON-CRYSTALLINE POLYETHER/INERT PLASTICIZER BINDER

This invention relates to solid composite propellant compositions composed of an oxidizer, a fuel and a binder.

BACKGROUND OF THE INVENTION

Prior to the invention of the class of binders including this invention, the state-of-the-art in solid propellants for man-rated or Department of Defense (DoD) class 1.3 (non mass-detonable) applications were those containing an inert hydroxy-terminated polybutadiene (HTPB) binder. These formulations generally contain 86 to 88% solids and use ammonium perchlorate oxidizer. They may also use an inert plasticizer such as dioctyl sebacate (DOS) or dioctyl adipate (DOA), aluminum fuel, and solid cyclic nitfamines cyclotetramethylene tetranitramine (HMX) or cyclotrimethylene trinitramine (RDX). The HTPB propellants are useful because they are less expensive and safer to use than double-base propellants which are DoD class 1.1 (mass-detonable).

HTPB propellants also have low electrical conductivities (or high resistivities) which makes them susceptible to catastrophic dielectric breakdown and other electrostatic hazards. Electrostatic discharge is known to have been the cause of disastrous fires which have occurred during the handling and manufacture of prior art rocket motors containing HTPB bound propellant.

HTPB propellants require high depressurization rates to extinguish. Consequently, they are not suitable for use in applications where thrust termination through rapid motor depressurization is required.

The instant inventors have developed a new class of propellants having binders made with non-crystalline polyethers which have improved safety (electrical conductivity), performance (density), and ballistics (extinguishment), as compared to the HTPB based propellants. One such propellant has a binder system comprising a non-crystalline polyether and an energetic plasticizer. The instant inventors have developed a propellant having similar performance features to those of that invention but which is safer, e.g., has even greater extinguishment, particularly during depressurization.

SUMMARY OF THE INVENTION

This invention is a solid propellant composition comprising an oxidizer, a fuel and a binder, wherein the binder comprises, based on the weight of the total propellant composition:

(a) from about 3 to about 12% of a non-crystalline polyether having a molecular weight of from about 1000 to about 9,000, and (b) from about 1 to about 12% of an inert plasticizer.

DETAILED DESCRIPTION OF THE INVENTION

This invention is a DoD Class 1.3 propellant. Such propellants are used for, e.g., ground-launched interceptors, air-launched tactical motors, and space boosters. Other uses of the propellant of this invention are for formulating into strategic, tactical, reduced smoke, and minimum smoke propellants and insensitive munitions.

Non-crystalline ("soft segment") polyethers useful in this invention include random copolymers of ethylene oxide and tetrahydrofuran ranging in molecular weight from 1000 to 3000 and ethylene oxide content of from 15 to 40%, by weight. These polyethers are available commercially from E.I. duPont de Nemours Inc. (Wilmington, Del.) as Teracol TE 2000 polyether (molecular weight=2000, ethylene oxide=38% and tetrahydrofuran=62%) and from the BASF Corporation (Parsippany, N.J.) as ER-1250/25 polyether (molecular weight=1250, ethylene oxide=25% and tetrahydrofuran=75%).

Inert plasticizers are defined as those materials that do not have a positive heat of explosion (HEX). HEX is the energy released by burning the propellant or ingredient in an inert atmosphere (e.g., 20 atm $N_2$) and then cooling to ambient temperatures in a fixed volume. Preferred for this invention are inert plasticizers having a negative HEX.

Inert plasticizers useful in this invention must be miscible (compatible) in non-crystalline polyethers. The non-crystalline polyethers of this invention are relatively polar (compared to HTPB). Consequently, inert plasticizers useful in this invention must also be relatively polar.

Preferably, the inert plasticizers have a solubility parameter ($\delta$) greater than or equal to 9 $(cal./cm^3)^{\frac{1}{2}}$ (the solubility parameter is a measure of the solvating power of the inert plasticizer and is calculated from thermodynamic constants for these materials).

Preferred plasticizers are triacetin, acetyl tri-n-butyl citrate (available commercially from Motflex Chemical Co., Inc., Greensboro, N.C., as Citroflex A-4), acetyl triethyl citrate (available commercially from Motflex Chemical Co., Inc. as Citroflex A-2), triethylene glycol bis-2-ethylbutyrate (available commercially from Union Carbide Corp., Bound Brook, N.J., as Flexol Plasticizer 3GH) and tetraethylene glycol bis-2-ethylhexoate (available commercially from Union Carbide Corp., Bound Brook, N.J., as Flexol Plasticizer 4G0).

Due to the higher relative polarity of the non-crystalline polyethers and inert plasticizers of this invention compared to HTPB-based formulations, the propellants of this invention are considerably more conductive and have higher breakdown potential (voltage) than their HTPB counterparts. Consequently, static electricity is dissipated much more rapidly and the likelihood of catastrophic dielectric breakdown and other electrostatic hazards are greatly reduced with this invention.

In addition, propellants containing the binders of this invention are readily extinguishable. Due to the oxygen contained in the polyether and plasticizer, the oxygen-to-fuel ratio (OMOX) is increased and less inorganic oxidizer (e.g., ammonium perchlorate) is required for efficient combustion. Use of lower levels of inorganic oxidizer is associated with more rapid extinguishment. For instance, an 83% solids propellant containing ER-1250/25 polyether and acetyl tri-n-butyl citrate extinguishes at depressurization rates as low as 15 kPsi/-second (from a chamber pressure of 1000 psi). In contrast, a depressurization rate of at least 158 kPsi/second is required to extinguish a conventional HTPB composite propellant. Use of lower levels of inorganic oxidizer is also associated with lower response to insensitive munition tests (e.g., bullet impact) and, as a result, improved safety.

Due to the oxygen present in the binder and resulting higher OMOX, high levels of fuel (e.g., aluminum powder) can be incorporated in the propellant and its density is significantly raised.

The non-crystalline polyether also allows for the formulation of propellants with much lower plasticizer levels (propellants with plasticizer-to-polymer ratios of 0.3 have been successfully formulated) relative to a propellant made with highly crystalline polyethers such as polyethylene glycol (PEG) and polytetrahydrofuran (PTHF). Non-crystalline polyethers form stable solutions with inert plasticizers, whereas PEG is only useful with energetic plasticizers (materials having a high heat of explosion) and slowly crystalizes and separates from solution at plasticizer to polymer ratios below 1.5. In addition, the polymers of this invention do not undergo synersis, a problem found with propellants containing PEG. The binders of this invention do not crystallize like the PTHF containing binders and, thus, do not suffer from reduced strain capability at low temperatures (ca. below 0° F.). Propellants of this invention have excellent low temperature mechanical properties.

The low plasticizer levels attainable with the non-crystalline polyethers have facilitated the formulation of propellants with high solids loadings and bonding agents. Compositions can be made with solids loadings as high as 89%. The high solids loadings attainable with these binders has improved the overall performance (i.e., volumetric impulse) of the propellants by raising the density. Since these propellants also contain oxygen in their binders, higher levels of fuel (e.g., aluminum) can also be used (relative to an HTPB propellant at the same OMOX). This provides even more density (performance).

The general compositional ranges of propellants of this invention containing the non-crystalline polyether and inert plasticizer is illustrated in Table I as follows:

TABLE I

General Compositional Ranges (Weight %) for Propellant Containing Non-Crystalline Polyether and Inert Plasticizer

| | |
|---|---|
| Solids Loading (preferably 80–87%) | 74–89% |
| Non-crystalline Polyether (molecular weight 1000–9000) | 3–10% |
| Inert Plasticizer (e.g., triacetin) | 3–10% |
| Bonding Agent (e.g., BHEGA[a] or Epoxy/Amine[b]) | 0–0.3% |
| Defunctional Isocyanate (Curing Agent) (e.g., IPDI[c], HDI[d], DDI[e]) | 0.5–2.0% |
| Polyfunctional Isocyanate (Curing Agent) (e.g., Desmodur N100 and L2291A, both available commercially from Mobay Corp., Pittsburgh, PA) | 0.1–0.8% |
| Oxidizer (e.g. ammonium nitrate, ammonium perchlorate, hydrazine nitrate, lithium nitrate) (preferably 5–65%) | 0–70% |
| Sodium Nitrate (Scavenger and/or oxidizer) | 0–60% |
| Cyclic Nitramine (e.g. HMX or RDX) | 0–50% |
| Fuel (e.g. Al, Mg, Zr and other powders (including blends thereof)) | 16–24% |
| Cure Catalyst (e.g., triphenyl bismuth or maleic anhydride) | 0–0.1% |
| Burning rate catalyst (e.g., iron oxide) | 0–1.0% |

[a]BHEGA = Bis-hydroxyethyl glycolamide, marketed by 3M Company, St. Paul, MN as Dynamar HX-80.
[b]Epoxy-Amine = 0.06% bis-phenol-A epoxy resin and 0.04% of triethylenetetramine (hardener).
[c]IPDI is isophorone diisocyanate.
[d]HDI is hexamethylene diisocyanate.
[e]DDI is dimeryl diisocyanate (difunctional curative).

The propellant of this invention is prepared using conventional means. As long as the propellant composition of this invention is mixed together in a reasonable length of time, there is no particular order to mixing the components together. Preferably, the propellants of this invention are prepared by adding the following sequentially to a mixing vessel:

(1) binder components (liquids);
(2) solid oxidizer(s) (incremental addition);
(3) bonding agent(s);
(4) solid fuel(s) (incremental addition); and
(5) cure catalyst(s) and curative(s) (isocyanate(s)).

Generally, after the bonding agent is added, the formulation is mixed under vacuum. Mix temperatures are typically 80° to 140° F. This procedure will vary depending on the specific ingredients.

The following examples illustrate the invention and compare it with similar HTPB propellants. Parts and percentages are by weight unless otherwise specified.

EXAMPLE 1

A propellant formulation for a space booster, prepared in a similar fashion to the preferred procedure described in the specification, had the composition shown in Table II below. The properties of this formulation were compared to an 88% solids HTPB propellant in Table III below. The propellant of this invention was found to be three to four orders-of-magnitude more conductive (i.e., the volume resistivity is lower than a comparable 88% solids HTPB propellant). Consequently, it was far less susceptible to electrostatic discharge (ESD) ignition (catastrophic dielectric breakdown), relative to the HTPB propellant. The higher conductivity of the propellant of this invention is also reflected in the higher dielectric constant for that formulation. The higher payload indicated for the propellant of this invention is due to the higher density of the formulation.

TABLE II

Composition of 87% Solids Propellant - Example 1

| Components | Percentages (By weight) |
|---|---|
| ER-1250/25 | 4.849 |
| Acetyl tri-n-butyl citrate (Citroflex A-4) | 6.5 |
| Epoxy-Amine Binding Agent[1] | 0.1 |
| DDI[2] | 1.309 |
| Polyfunctional curative[3] | 0.142 |
| Triphenyl Bismuth (cure catalyst) | 0.05 |
| Maleic Anhydride (cure catalyst activator) | 0.05 |
| Ammonium Perchlorate | 63.5 |

TABLE II-continued

| Composition of 87% Solids Propellant - Example 1 | |
|---|---|
| Components | Percentages (By weight) |
| Aluminum Powder | 23.5 |

[1]Consisting of 0.06% bisphenol-A epoxy resin and 0.04% triethylenetetramine (hardening agent).
[2]Dimeryl diisocyanate - difunctional curative.
[3]Desmodur N100 - aliphatic polyisocyanate manufactured by Mobay Corp., Pittsburgh, PA.

TABLE III

| HTPB/DOS (88% Solids) vs ER-1250/ Acetyl tri-n-butyl citrate ("ATBC") (87% Solids) | | |
|---|---|---|
| | HTPB/DOS (88% Solids) (Prior Art) | ER-1250/ATBC (87% Solids) |
| Performance | | |
| I°sps[a] [lb(force) × sec/lb (mass)] | 263.6 | 260.8 |
| Density (lb/in$^3$) | 0.065 | 0.067 |
| OMOX[b] | 1.26 | 1.26 |
| Δ payload[c], (lbs) | +4190 | +8687 |
| Mechanical Properties[d] 2 ipm @ 77° F. | | |
| δm, psi | 116 | 150 |
| εm, % | 35 | 69 |
| E, psi | 552 | 550 |
| Safety | | |
| Volume Resistivity @ 20 Volts (ohm-cm) | $10^{13}$ | $8.4 \times 10^9$ |
| Dielectric Constant @ 1000 Hz | 8 | 13.1 |

[a]I°sps is the theoretical specific impulse at sea level.
[b]OMOX, in a propellant formulation, is defined as the ratio of the moles of oxygen to the sum of the moles of carbon plus 1.5 times the moles of aluminum (OMOX = moles $O_2$/(moles C + 1.5 moles Al)). This parameter is widely used for correlations of rocket propellant performance.
[c]Based on NASA partials for Space Shuttle solid rocket motor performance calculations. Payload is relative to TP-H1148.
[d]All mechanical properties were obtained using tensile test machines such as Instron or Terratek.

EXAMPLE 2

An 83% solids propellant formulation for a ground-launched short range ballistic missile, prepared in a similar fashion to the preferred procedure described in the specification, had the formulation shown in Table IV. This propellant is more readily extinguishable than a comparable 88% solids HTPB propellant, as shown in Table V. That the propellant of this invention extinguished at a depressurization rate of 15,000 psi/second, whereas the HTPB based propellant required a rate of 158,000 psi/second. In addition, the propellant of this invention passed a variety of insensitive munitions tests (bullet impact, slow cookoff, fast cookoff and sympathetic detonation). Most notable was that the propellant of this invention had no reaction to bullet impact, whereas the HTPB based propellant burned completely.

TABLE IV

| Composition of 83% Solids ER-1250/Acetyl tri-n-butyl citrate (ATBC) Propellant | |
|---|---|
| | Percentage (Weight) |
| Polyether (ER-1250/25) | 6.930 |
| ATBC (Citroflex A-4) | 8.5 |
| Epoxy-Amine Bonding Agent[1] | 0.1 |
| IPDI[2] | 1.046 |
| Polyfunctional curative[3] | 0.324 |
| Tris-para-ethoxyphenyl Bismuth[4] | 0.05 |
| Maleic Anhydride (Cure Catalyst Activator | 0.05 |

TABLE IV-continued

| Composition of 83% Solids ER-1250/Acetyl tri-n-butyl citrate (ATBC) Propellant | |
|---|---|
| | Percentage (Weight) |
| Ammonium Perchlorate | 54.0 |
| Cyclic Nitramine (HMX) | 10.0 |
| Aluminum Powder | 19.0 |

[1]Consisting of 0.06% bisphenol-A epoxy resin and 0.04% triethylenetetramine (hardening agent).
[2]Isophorone diisocyanate - difunctional curative.
[3]Desmodur N100 - aliphatic polyisocyanate manufactured by Mobay Corp., Pittsburgh, PA.
[4]Cure catalyst.

TABLE V

| HTPB/DOS (88% Solids) vs ER-1250/Acetyl tri-n-butyl citrate (ATBC) Insensitive Munitions and Extinguishment Properties | | |
|---|---|---|
| | HTPB/DOS (88% Solids) (prior art) | ER-1250/ATBC (83% Solids) |
| Bullet Impact (30.06 caliber @ 50 feet) | Ignited and burned | Did not ignite |
| ESD Charge Dissipation (seconds) | 2.0 | 0.002 |
| ESD Breakdown Voltage (kV) | 6 | 30 |
| Depressurization Rate for Extinguishment (Psi/second) | 158,000 | 15,000 |

EXAMPLE 3

An 87% solids propellant for an air-launched short range attack missile, prepared in a similar fashion to the preferred procedure described in the specification, had the composition shown in Table VI. As shown in Table VII, this propellant had lower Isp, but much higher density and volumetric impulse than a typical 88% solid HTPB propellant.

TABLE VI

| Composition of 87% Solids ER-1250 Acetyl tri-n-butyl citrate (ATBC) Propellant | |
|---|---|
| | Percentage (Weight) |
| Polyether (ER-1250/25) | 5.05 |
| ATBC (Citroflex A-4) | 6.5 |
| Epoxy-Amine Bonding Agent[1] | 0.1 |
| IPDI[2] | 0.72 |
| Polyfunctional Curative[3] | 0.63 |
| Tris-para-ethoxyphenyl Bismuth[4] | 0.02 |
| Maleic Anhydride (Cure Catalyst Activator) | 0.02 |
| Ammonium Perchlorate | 53.0 |
| Cyclic Nitramine (HMX) | 12.0 |
| Aluminum Powder | 22.0 |

[1]Consisting of 0.06% bisphenol-A epoxy resin and 0.04% triethylenetetramine (hardening agent).
[2]Isophorone diisocyanate - difunctional curative.
[3]Desmodur N100 - aliphatic polyisocyanate manufactured by Mobay Corp., Pittsburg, PA.
[4]Cure catalyst.

TABLE VII

| HTPB/DOS (88% Solids) vs ER1250/ATBC (87% Solids) Air-Launched Propellant Properties | | |
|---|---|---|
| | HTPB/DOS (88% Solids) | ER-1250/ATBC (87% Solids) |
| Performance | | |
| I°sps [lb(force) × sec/lb (mass)] | 263.5 | 262.9 |
| Density (lb/in$^3$) | 0.065 | 0.067 |
| OMOX | 1.221 | 1.156 |

TABLE VII-continued

| HTPB/DOS (88% Solids) vs ER1250/ATBC (87% Solids) Air-Launched Propellant Properties | | |
|---|---|---|
| | HTPB/DOS (88% Solids) | ER-1250/ATBC (87% Solids) |
| Isp and Density | 17.18 | 17.53 |

While this invention has been described with respect to specific embodiments, it should be understood that they are not intended to be limiting and that many variations and modifications are possible without departing from the scope of this invention.

What is claimed:

1. A solid propellant composition comprising an oxidizer, a fuel, a binder, wherein the binder comprises, based on the weight of the total propellant composition:

(a) 3–12% of a non-crystalline polyether having a molecular weight of 1000–9000, and (b) 1–12% of an inert plasticizer.

2. The solid propellant composition of claim 1 wherein the binder has a negative heat of explosion.

3. The solid propellant composition of claim 1, the propellant further comprising at least one additive selected from a bonding agent, burning rate additive, scavenger and catalyst.

4. The solid propellant composition of claim 1 wherein the non-crystalline polyether is selected from random copolymer of ethylene oxide and tetrahydrofuran.

5. The composition of claim 4 wherein the random copolymer has an ethylene oxide moiety content of 15–40% and a molecular weight of 1000–3000.

6. The solid propellant composition of claim 1 wherein the inert plasticizer is selected from triacetin, acetyl tri-n-butyl titrate, acetyl triethyl citrate, triethylene glycol bis-2-ethylbutyrate and tetraethylene glycol bis-2-ethylhexoate.

7. The solid propellant composition of claim 2 wherein the inert plasticizer is selected from triacetin, acetyl tri-n-butyl citrate, acetyl triethyl citrate, triethylene glycol bis-2-ethylbutyrate and tetraethylene glycol bis-2-ethylhexoate.

8. The solid propellant composition of claim 5 wherein the inert plasticizer is selected from triacetin, acetyl tri-n-butyl citrate, acetyl triethyl citrate, triethylene glycol bis-2-ethylbutyrate and tetraethylene glycol bis-2-ethylhexoate.

9. The composition of claim 1 wherein the fuel is selected from aluminum, magnesium, and zirconium powders, and mixtures thereof.

10. The composition of claim 2 wherein the fuel is selected from aluminum, magnesium, and zirconium powders, and mixtures thereof.

11. The composition of claim 5 wherein the fuel is selected from aluminum, magnesium, and zirconium powders, and mixtures thereof.

12. The composition of claim 8 wherein the fuel is selected from aluminum, magnesium, and zirconium powders, and mixtures thereof.

13. The composition of claim 1 wherein the inert plasticizer has a solubility parameter ($\delta$) greater than or equal to 9.

14. The composition of claim 2 wherein the inert plasticizer has a solubility parameter ($\delta$) greater than or equal to 9.

15. The composition of claim 5 wherein the inert plasticizer has a solubility parameter ($\delta$) greater than or equal to 9.

16. The composition of claim 8 wherein the inert plasticizer has a solubility parameter ($\delta$) greater than or equal to 9.

17. The composition of claim 9 wherein the inert plasticizer has a solubility parameter ($\delta$) greater than or equal to 9.

18. The composition of claim 12 wherein the inert plasticizer has a solubility parameter ($\delta$) greater than or equal to 9.

* * * * *

UNITED STATES PATENT AND TRADEMARK OFFICE

CERTIFICATE OF CORRECTION

PATENT NO. : 5,348,596

DATED : Sept. 20, 1994

INVENTOR(S) : Goleniewski et al

It is certified that error appears in the above-indentified patent and that said Letters Patent is hereby corrected as shown below:

Col. 1, line 19, delete "nitfamines" and insert -- nitramines --;

Col. 2, line 30, delete "Motflex" and insert -- Morflex --;

Col. 2, line 32, delete "Motflex" and insert -- Morflex --;

Col. 3, line 48, (In Table 1) delete "Defunctional" and insert -- Difunctional --;

Col. 5, line 48 (in Example 2), delete "That the propellant" and insert -- That is, the propellant --;

Col 7, line 36, delete "titrate" and insert -- citrate --.

Signed and Sealed this

Fifth Day of September, 1995

*Attest:*

*Attesting Officer*

Bruce Lehman

BRUCE LEHMAN

*Commissioner of Patents and Trademarks*